US009275841B2

(12) United States Patent
Moore

(10) Patent No.: US 9,275,841 B2
(45) Date of Patent: Mar. 1, 2016

(54) TIME OF FLIGHT MASS SPECTROMETER UTILIZING OVERLAPPING FRAMES

(75) Inventor: George Stennis Moore, Veradale, WA (US)

(73) Assignee: Agilent Technologies, Inc., Santa Clara, CA (US)

( * ) Notice: Subject to any disclaimer, the term of this patent is extended or adjusted under 35 U.S.C. 154(b) by 231 days.

(21) Appl. No.: 13/587,842

(22) Filed: Aug. 16, 2012

(65) Prior Publication Data

US 2014/0048698 A1 Feb. 20, 2014

(51) Int. Cl.
*H01J 49/40* (2006.01)
*H01J 49/00* (2006.01)

(52) U.S. Cl.
CPC ..... *H01J 49/0036* (2013.01)

(58) Field of Classification Search
CPC .. H01J 49/0036; H01J 49/40; G01N 30/8631; G06K 9/0051; G06F 19/02
USPC ..... 250/282, 288; 436/43, 50, 171; 702/23, 702/32, 79, 80, 181
See application file for complete search history.

(56) References Cited

U.S. PATENT DOCUMENTS 6,782,342 B2 8/2004 LeGore
7,463,983 B1 * 12/2008 Patrick ..... 702/28
7,684,932 B2 * 3/2010 Hidalgo et al. ..... 702/23
8,017,907 B2 * 9/2011 Willis et al. ..... 250/282
2009/0074083 A1 * 3/2009 Wakutsu ..... 375/240.28
2009/0125550 A1 * 5/2009 Barga et al. ..... 707/104.1
2011/0024620 A1 * 2/2011 Hidalgo et al. ..... 250/287
2012/0109537 A1 * 5/2012 Makarov ..... 702/27
2012/0245889 A1 * 9/2012 Zhu et al. ..... 702/181
2013/0013274 A1 * 1/2013 Grothe, Jr. ..... 703/2

OTHER PUBLICATIONS

F. Samman, P. Surapong, and M. Glesner, "Reconfigurable streaming processor core with interconnected floating-point arithmetic units for multicore adaptive signal processing systems," in 6th International Workshop on Reconfigurable Communication-centric Systems-on-Chip, Jun. 20-22, 2011, pp. 1-6.*

A Hypergeometric Probability Model for Protein Identification and Validation using Tandem Mass Spectral Data and Protein Sequence Databases, R.G. Sadygov, and J. R. Yates III, Analytical Chemistry 2003;75:3792-3798.*

* cited by examiner

*Primary Examiner* — B. Purinton

(57) ABSTRACT

A time of flight (TOF) spectrometer and a method for operating the same is disclosed. The spectrometer includes an event extractor, a streaming processor, and a FIFO buffer. The event extractor generates a ion event record corresponding to each detected ion, the ion event record including an intensity of a plurality of aliases for that detected ion. The streaming processor includes a memory array that stores a TOF spectrum and a probability processor that provides a probability for each alias in each received ion event record and updates the TOF spectrum based on the probabilities. A FIFO buffer receives each of the ion event records after the TOF spectrum has been updated and outputs the oldest ion event record to the streaming processor when a new ion event record is processed by the streaming processor.

18 Claims, 3 Drawing Sheets

TIME OF FLIGHT MASS SPECTROMETER UTILIZING OVERLAPPING FRAMES

BACKGROUND

Time-of-flight mass spectrometers (TOFMSs) measure the abundance of ions in an analyte as a function of the time required for those ions to travel from an ion source to an ion detector that is located at a fixed distance from the ion source. Ions from the ion source are subjected to a short acceleration pulse by applying a voltage between the ion source and an acceleration electrode. The kinetic energy imparted to an ion is proportional to the charge on that ion and the acceleration voltage. The velocity of the ions after acceleration is determined by the acceleration voltage and the mass-to-charge ratio of the ions. Hence, the time of flight (TOF) between the ion source and the detector is a measure of the mass-to-charge ratio of the ions. The ion detector converts an ion impact to an electrical pulse. The spectrum produced by TOFMSs is the charge received by the ion detector as a function of time measured from the time of the acceleration pulse.

The low abundance and statistical nature of the ion impact response necessitate that the spectra from a large number of single pulses are combined to provide the final spectrum for a sample that is being analyzed. For any given application, there is a maximum TOF of interest. In the following discussion, the reciprocal of this TOF will be referred to as the "reference rate". If the source is pulsed at a rate less than or equal to the reference rate, all of the ions of interest from any given packet will be detected prior to ions from a subsequent pulse arriving at the ion detector. The reference rate is the fastest rate at which the source can be pulsed without having ions of interest from one pulse reaching the detector at a time after ions from a previous pulse have not yet reached the detector.

The time to acquire a spectrum using the reference rate can be too long for many applications. If the analyte is changing over time, the analysis needs to be completed in a time that is much less than the time the analyte evolves. Even in the case of relatively stable samples, there is a limit to the time available on the TOFMS.

One method for decreasing the time needed to acquire a spectrum utilizes a scheme in which the ion source is pulsed at an average rate much higher than the reference rate. In this system, an ion reaching the ion detector could have resulted from any one of a number of pulses. By randomly varying the interpulse interval, the identity of the pulse giving rise to the ion may be determined with high accuracy.

Denote the ions that arrive from a single ion pulse within the range of allowed times of flight as a "transient". If the source is pulsed at a rate less than or equal to the reference rate, the transients do not overlap, and hence, the launching pulse corresponding to each detected ion is known, and the TOF is the difference in time between the time of the pulse and the time at which the ion was detected. Processing the data from transients to arrive at TOF values for each ion is then relatively simple; however, the data acquisition rate is limited by the number of ions that can be launched in a packet and the TOF of the slowest ion species of interest.

The number of ions per packet is constrained by the available ion sources. In addition, the ion density must not be so great as to have the ions interacting with each other in a manner that alters the TOF of the individual ions or causes the packet to expand so that ions are lost.

There are applications in which the number of transients per unit time must be increased above the reference rate. For example, experiments in which the sample changes significantly in a time that is less than the time needed to collect sufficient impacts at the reference rate pose significant challenges if the TOFMS is limited to the reference rate.

If the TOFMS is operated at a rate above the reference rate, the transient responses will overlap. In this case, the pulse that gave rise to any given ion hitting the detector is not uniquely known from the time of arrival of the ion at the ion detector. For example, an ion striking the detector could be a fast moving ion from the last pulse or a slow moving ion from an earlier pulse. One method for generating a spectrum from such overlapping frames is disclosed in U.S. Pat. No. 8,080,782. In this method, the launching pulses are provided at variable intervals about some predetermined interval that is much shorter than the reference period. An algorithm that makes use of the random nature of the pulses is then used to generate the TOF spectrum by a method that will be discussed in more detail below. For the purposes of the present discussion, it is sufficient to note that the computational workload presented by this algorithm is significant. As a result, the time needed to actually generate a spectrum is much longer than the time needed to accumulate sufficient detector hits.

In applications in which the final spectrum is all that is required, the computations can be performed "off-line". Hence, the spectrum acquisition time can be significantly improved as measured by the time needed to acquire the data on the TOFMS and the temporal evolution of rapidly evolving spectra can be more closely followed.

There are applications, however, in which the spectrum, or a reasonable approximation thereof, must be available in a time that is less than the processing time of the algorithm discussed above. Consider an experiment in which the sample that is being analyzed is changing with time in a manner that a component of interest is detected during the course of the experiment. When the component appears, the experimental protocol is to be changed. For example, if the component is detected with a TOFMS, a spectrum having sufficient accuracy to detect the component of interest must be available before the component disappears. In this case, the experiment cannot wait for the off-line processing discussed above. Accordingly, a method for providing a reasonable approximation to the final TOFMS spectrum with a minimal time delay is needed.

SUMMARY

The present invention includes a spectrometer and a method for operating the same. The spectrometer includes an ion source that emits packets of ions and an ion detector that detects ions. The spectrometer also includes an event extractor, and a streaming processor. The event extractor generates a ion event record corresponding to each of the detected ions, the ion event record including an intensity associated with that detected ion and one or more aliases for that detected ion. The streaming processor receives the ion event record, stores a TOF spectrum, and updates that TOF spectrum for each alias in each received ion event record, the updates depending on a probability for each alias in each received ion event record and the intensity in that ion event record. The streaming processor stores the received ion event records in a buffer together with a timestamp associated with each received ion event record.

In one aspect of the invention, the streaming processor removes one of the ion event records from the buffer when the timestamp associated with that ion event record indicates that the ion event record is an expired ion event record. The streaming processor removes contributions to the TOF spectrum from the expired ion event record when the expired ion event record is removed from the buffer.

In another aspect of the invention, the TOF spectrum includes a memory array having a plurality of entries, each entry corresponding to a different possible TOF value for ions detected by the detector. The probabilities of all the aliases in one of the ion event records are set to be equal if all entries in the memory array corresponding to the aliases in that one of the ion event records are zero. The probability for each alias in one of the ion event records is proportional to a corresponding entry in the memory array if any of the aliases in that one of the ion event records corresponds to a memory entry in the memory array that is non-zero.

In a still further aspect of the invention, the ion source emits pulses in a pattern that ensures that contributions to the TOF spectrum resulting from incorrect aliases are substantially uniform.

In another aspect of the invention, the streaming processor discards an ion event record after the streaming processor removes the contributions from that ion event record from the TOF spectrum.

In yet another aspect of the invention, the streaming processor treats an ion event record whose contribution has been removed from the TOF spectrum as a new ion event record after the streaming processor removes the contributions of that ion event record from the TOF spectrum.

DETAILED DESCRIPTION

Figure 1:
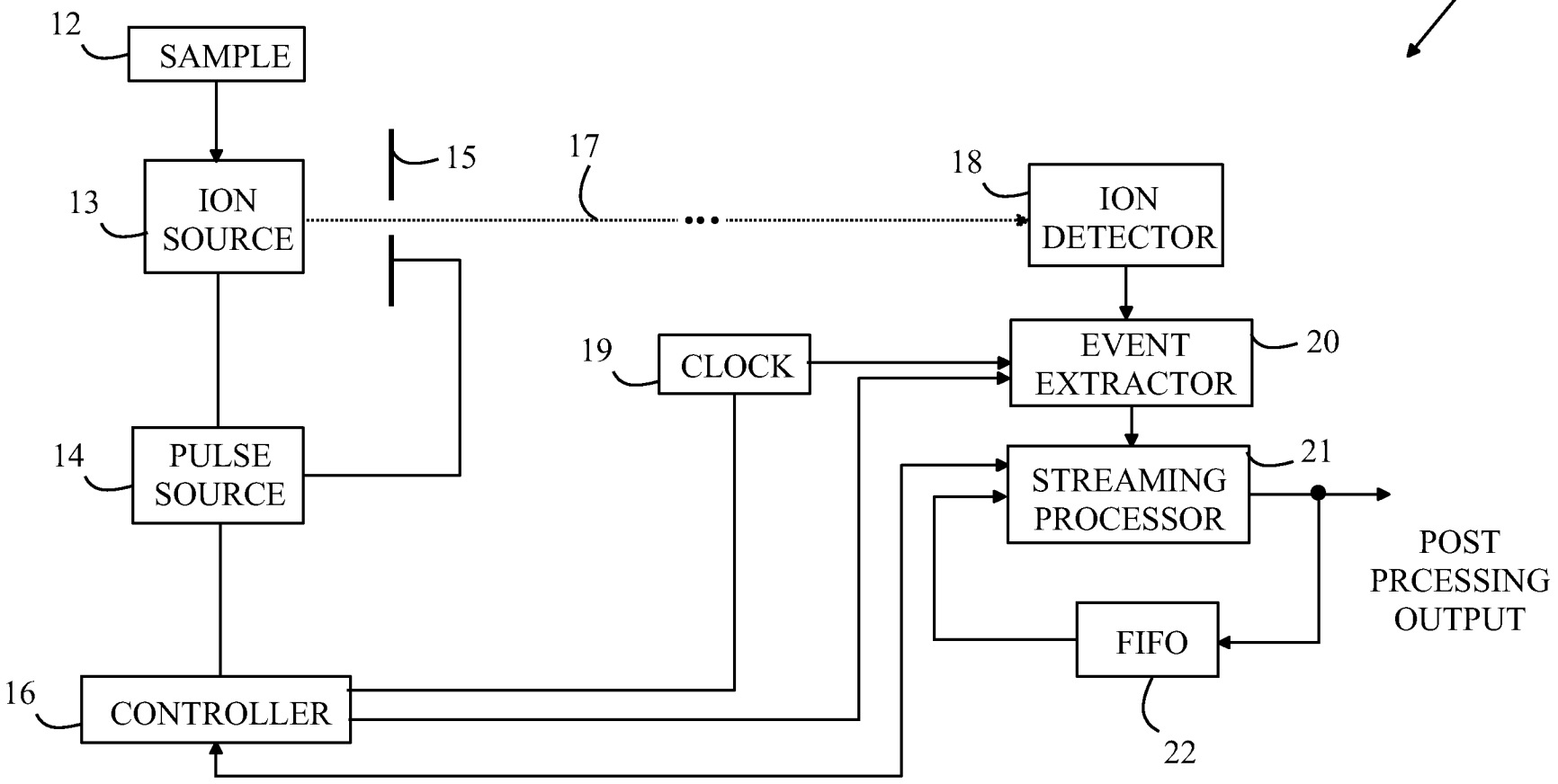
FIG. 1 illustrates a basic TOFMS apparatus that utilizes a processing algorithm according to one embodiment of the present invention.

The manner in which the present invention provides its advantages can be more easily understood with reference to FIG. 1 which illustrates a basic TOFMS apparatus that utilizes a processing algorithm according to one embodiment of the present invention. TOFMS 10 analyzes a sample 12 that is ionized by an ion source 13. Ions from ion source 13 are formed into an ion packet by applying a short electrical pulse between ion source 13 and acceleration electrode 15. The energy imparted to each ion is determined by the charge on the ion and the potential difference between ion source 13 and acceleration electrode 15 during the pulse. The accelerated ions travel along a flight path 17 and strike an ion detector 18 which generates an impact signal.

The timing of the electrical pulses is controlled by a controller 16 via a pulse source 14. Controller 16 records the time at which each pulse is generated by accessing a clock 19. An event extractor 20 receives the output of ion detector 18 and records the time at which each detection event occurs provided the output of ion detector satisfies some detection criterion such as having a signal intensity that exceeds some threshold value. Other detection criteria will be discussed below. Event extractor 20 generates an ion event record for each detected ion. The contents of this record will be discussed in detail below. For the purposes of this discussion, it is sufficient to note that the record includes the possible times of flight that are consistent with the pulse timing and the amplitude of the signal from the ion detector.

The event records are input to a streaming processor 21 which maintains a running estimate of the TOF spectrum. The estimate provides an amplitude as a function of TOF. The amplitudes are weighted sums of the amplitudes in the event records. The spectrum is stored in a memory array in which each memory location has weighted sums generated from the event records corresponding to a TOF associated with that memory location. The new records are used to update the memory array in a manner that will be discussed in more detail below. After being used to update the memory array, the records are input to a FIFO buffer 22 with a timestamp. Ion event records that are older than a predetermined value are said to have expired. Ion event records are output from the FIFO as the ion event records expire. The contents of each retrieved expired ion event record are then used to update the memory array by removing the contribution of that expired ion event record from the current contents of the memory array such that the memory array contains an estimate of the TOF spectrum based on ion event records spanning a specified range of times.

Figure 2:
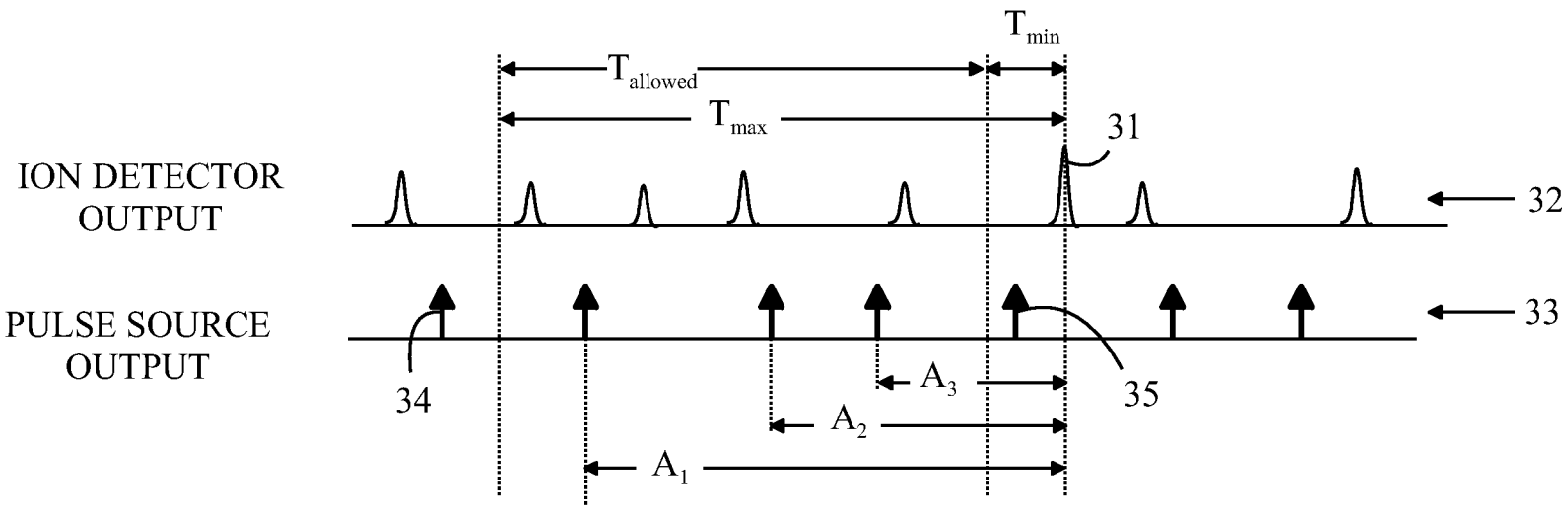
FIG. 2 illustrates the output of the ion detector as a function of time.

The contents of the ion event records will now be explained in more detail with reference to FIG. 2, which illustrates the output of the ion detector as a function of time. The ion detector generates a pulse each time an ion is detected as shown at 32. The ions are generated in response to the pulse source output shown at 33. The amplitude/duration of the response depends on the ion energy/momentum and the details of the ion detector. For any given impact event, aliases are defined for all the possible ion source pulses from which the ion may have originated. These are the source pulses that fall in a range between some minimum TOF, $T_{min}$, and a maximum TOF, $T_{max}$. $T_{max}$ is determined by the slowest ion of interest, and $T_{min}$ is determined by the fastest ion of interest. Consider the event corresponding to the ion detector output signal shown at 31. This event could not be associated with the pulse shown at 34, since the TOF would be greater than $T_{max}$. Similarly, the event could not be generated by the pulse shown at 35, since the corresponding TOF is less than $T_{min}$. In the example shown here, the event could only be the result of three pulses from the ion source that occurred during $T_{allowed}$. Denote the TOFs associated with each of these pulses by $A_1$-$A_3$, respectively. These possible TOF values will be referred to as "aliases" in the following discussion.

Each event record includes the possible aliases for that event. Each event record also includes a probability associated with each of the aliases. Streaming processor 21 assigns the probabilities for each alias based on the running estimate of the TOF spectrum.

To simplify the following discussion, it will be assumed that each ion detection event occurs at a single time. That is, the ion detector output is digitized by an analog-to-digital converter (ADC) that operates at a defined clock rate. In the following discussion, it will be assumed that the detection event spans only one time bin, i.e., the events shown at 32 each occur in a time that is less than one period of this clock. As a result, it will be assumed that each alias has a unique TOF value. The manner in which events that span multiple time bins are handled will be discussed in more detail below.

Denote the contents of the spectrum memory array by S(i). The index, i, denotes a possible TOF value. Hence, S(A) denotes the amplitude associated with the TOF represented by an alias, A. Consider the memory array when an ion event record having M aliases, $A_i \ldots A_M$ is to be processed by streaming processor 21. In general the probability associated with each alias is $$P_i = \frac{S(A_i)}{\sum_{j=1}^{M} S(A_j)} \quad (1)$$

Here, M is the number of aliases in the event record. In the beginning, all of the S(i) will be zero. In this case, there is insufficient data to make the assignment based on the contents of S(i). In this "0/0" case, $P_i$=1/M for i=1 to M. That is, all aliases are assumed to have equal probability.

Once the probabilities are assigned to an ion event record, the streaming processor updates the spectrum array. Denote the amplitude of the detector signal associated with the ion event record by I. Then the spectrum memory array is updated by adding $I*P_j$ to $S(A_j)$ for j=1 to M. The ion event record is then input to FIFO buffer 22 and output for additional post processing When the ion event record emerges from FIFO buffer 22 and re-enters streaming processor 21, the spectrum memory array is updated to remove the contribution of the old event from the spectrum by subtracting $I*P_j$ from $S(A_j)$ for j=1 to M. The event record is then either discarded or re-processed as described below.

Figure 3:
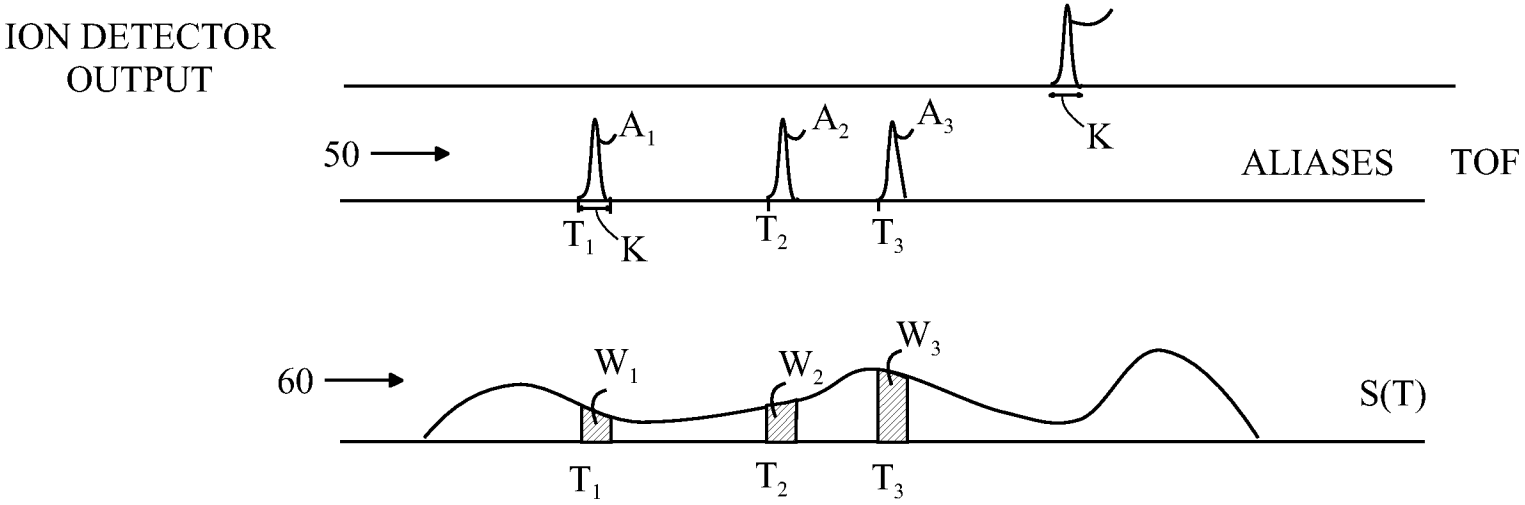
FIG. 3 illustrates the manner in which events are processed in one embodiment of the present invention in the case in which the response from the ion detector to events spans multiple ADC clock periods.

In the above-described embodiments, the output of the ion detector was digitized at some ADC clock rate and each event spanned only one clock period. In practice, each ion detection event spans a plurality of ADC clock periods. Refer now to FIG. 3, which illustrates the manner in which events are processed in one embodiment of the present invention in the case in which the events from the ion detector span multiple ADC clock periods. The output for a single ion detection event is shown at 51. The output spans K clock periods. Assume that this event gives rise to the three aliases shown at $A_1$-$A_3$ shown at 50. Each alias also spans K clock periods. Alias $A_1$ starts at TOF value $T_1$ and runs to $T_1$+K−1. Similarly, alias $A_2$ starts at TOF value $T_2$ and runs to $T_2$+K−1, and so on.

The cumulative TOF spectrum S(T) at the time ion event 51 is detected is shown at 60. Denote the area under S(T) for the time values from $T_n$ to $T_n$+K−1 by $W_n$, where n runs from 1 to 3. The probability assigned to alias, $A_n$, is $P_n=W_n/D$, where $D=\Sigma W_n$, for n=1 to 3. The alias, $A_n$, is an array of K intensity values, $I_{n,j}$, each value corresponding to the intensity of the output of the ion detector in a corresponding one of the clock periods, which can be written explicitly as $I_{n,j}$, where j runs from $T_n$ to $T_n$+K−1. Given this notation, the TOF spectrum is then updated for each alias in this event as follows:

$$S(j) \rightarrow S(j) + P_n * I_{n,j}$$

for j=$T_n$ to $T_n$+K−1.

It should be noted, however, that other methods for dealing with ion detector events that span multiple ADC clock periods could be utilized. For example, the output of the ion detector could be treated as an event that occurs at the average time value of the pulse shown at ion event 51 in FIG. 3. The intensity of the average pulse would then be proportional to the area under ion event 51.

In another aspect of the invention, the detector output is blanked during the period of time around the rise and fall of the ion pulse signal that is applied to the ion source rises and falls to prevent electrical interference from the pulse generator from generating spurious signals from the ion detector.

The above-described embodiments utilize a non-uniform pulsing scheme to drive the ion source. Every event record may have a plurality of aliases. If the event was the result of a single ion striking the detector, one of these is the true TOF and the others are not. The aliases that are not the true TOF will be referred to as the "incorrect aliases" in the following discussion. The pulsing scheme is chosen such that the distribution of TOF values for the incorrect aliases is substantially uniform. In this case, the incorrect aliases form a substantially uniform background when these aliases are added into the spectrum memory array with equal probabilities. In one aspect of the invention, pseudo-randomly computed firing intervals are used to trigger the ion source. On average the source is fired at a rate that is significantly greater than the reference rate discussed above. However, the intervals between firings varies randomly about this reference period.

For the purposes of this discussion, the distribution of incorrect aliases is defined to be "substantially uniform" if any peaks in the TOF spectrum that result from incorrect aliases are less than the intensity of the lowest intensity correct alias peak that is to be detected. In general, there is no minimum detection threshold that is dictated by the particular experiment being run on the TOFMS. If any non-uniformities in the incorrect alias spectrum are below this threshold, the substantially uniform criterion is defined to be met.

The assignment of probabilities based on the running content of the spectrum memory array leads to a better estimate of the correct spectrum than would be obtained by assigning equal probabilities to all of the aliases. If each incoming ion event record is assigned equal probabilities, the contributions corresponding to each of the correct aliases constructively add while the remaining aliases generate a substantially uniform noise floor. This noise floor can obscure weaker peaks in the spectrum. By utilizing the running spectrum to compute the probabilities, the noise floor is lowered and the true alias location responses are enhanced.

Given the events that were used to generate the spectrum, the noise floor can be iteratively lowered further if there is sufficient time available and a better estimate of the spectrum is needed. In one aspect of the invention, the iterative processing is performed by cycling the update algorithm using the stored events in FIFO buffer 22 multiple times before events are discarded due to aging.

Consider an event that has just been received from FIFO buffer 22 because it has expired. In the normal processing discussed above, the contributions of this event to the memory array are subtracted from the memory array and the event is discarded. In the iterative processing algorithm, instead of discarding the event, the event is treated as a new event from event extractor 20. The aliases of the event are assigned new probabilities based on the current contents of the memory array. The memory array is then updated to reflect the "new" event with the new probabilities, and the "new event" is re-input to FIFO buffer 22. When all of the events in FIFO buffer 22 have been reprocessed in this manner, one iteration will have been completed. The updated spectrum at the end of this iteration will be a better approximation to the actual TOF spectrum. The process can be repeated to further improve the approximation to the actual TOF spectrum.

While the above described iteration is performed in the streaming processor, embodiments in which the iteration is performed off-line by copying the events that went into the FIFO and the state of the spectrum memory array can also be constructed.

A hybrid system in which one iteration is effectively performed during the normal processing can also be constructed as follows. Assume that streaming processor 21 can accommodate twice the rate of events as the rate generated by event extractor 20. Each ion event record includes an indication as to whether or not it has been recycled. Events enter streaming processor 21 in the same manner as discussed above. Events from FIFO buffer 22 also enter streaming processor 21 and are processed as discussed above with reference to the iterative process. That is, the TOF contributions for each event from FIFO buffer 22 are first subtracted from the TOF spectrum. If the ion event record has not been recycled once, the ion event record is processed in the same manner as an ion event record from event extractor 20, and the ion event record is marked as having been recycled. When an ion event record that has been recycled exits FIFO buffer 22, that ion event record's contribution to the TOF spectrum is removed and the ion event record is discarded. This embodiment requires twice the FIFO buffer size as an embodiment without the built in recycling. While this hybrid system has been described in terms of one round of recycling, a system that utilizes multiple rounds of recycling can also be constructed. In such a system, the ion event records include a count of the number of times an ion event record has been processed through the streaming processor. Alternatively, the events can be recycled until the time span over which a given event is utilized exceeds some predetermined time.

As noted above, the event extractor generates the event records from the output of the ion detector. In general, the ion detector outputs a signal as a function of time that spans a finite range of TOF bins. In some cases, two ions will strike the ion detector at times that are separated by less than the width of the ion detector signal for one ion. In the simplest embodiment of an ion detector for use in the present invention, such multiple events are treated as a single ion striking the ion detector in which the event has a duration that extends for multiple ADC clock cycles as described above. Alternatively, the signal from the ion detector could be fitted to a multiple ion model and the intensities and times of arrival of the individual ions estimated.

The above-described embodiments utilize a FIFO buffer for storing the ion event records that were used to update the TOF spectrum until those ion event records expire. Since ion event records typically expire in the order in which the ion event records enter the buffer, a FIFO buffer is particularly well adapted for the ion event record storage, since the entire buffer does not need to be searched for expired events. However, other forms of storage buffer could be utilized in conjunction with a search strategy for finding the expired ion event records.

The above-described embodiments of the present invention have been provided to illustrate various aspects of the invention. However, it is to be understood that different aspects of the present invention that are shown in different specific embodiments can be combined to provide other embodiments of the present invention. In addition, various modifications to the present invention will become apparent from the foregoing description and accompanying drawings. Accordingly, the present invention is to be limited solely by the scope of the following claims.

What is claimed is:

1. A spectrometer comprising:

an event extractor configured to generate an ion event record corresponding to each ion satisfying a detection criterion detected by an ion detector, said ion event record including an intensity and one or more aliases for that detected ion; and a streaming processor configured to receive said ion event records, store a time-of-flight (TOF) spectrum, and update that TOF spectrum for each alias in each of said received ion event records, said updates depending on a probability for each alias in each received ion event record and said intensity in that ion event record, said streaming processor storing said received ion event records in a buffer, wherein each received ion event record comprises a timestamp determined by a time said received ion event record was received by said streaming processor.

2. The spectrometer of claim 1 wherein said streaming processor removes one of said ion event records from said buffer and removes all contributions to said TOF spectrum from said ion event record, said one of said ion event records being an ion event record that has been in said buffer for longer than a predetermined time based on said timestamp.

3. The spectrometer of claim 2 wherein said one of said ion event records is discarded after said contributions are removed from said TOF spectrum.

4. The spectrometer of claim 2 wherein said one of said ion event records is treated as a new ion event record received from said event extractor by said streaming processor after said contributions to said TOF spectrum have been removed.

5. The spectrometer of claim 1 wherein said TOF spectrum is stored in a memory array having a plurality of entries, each entry corresponding to a different possible TOF value for ions detected by said detector and wherein said streaming processor is configured to set said probabilities of all aliases in one of said ion event records to be equal to one another if all entries in said memory array corresponding to said aliases in that one of said ion event records are zero.

6. The spectrometer of claim 5 wherein said probability for each alias in one of said ion event records is proportional to a corresponding entry in said memory array if any of said aliases in said one of said ion event records corresponds to a memory entry in said memory array that is non-zero.

7. The spectrometer of claim 1 wherein said ions are emitted in pulses in a pattern that ensures that contributions to said TOF spectrum resulting from incorrect aliases are substantially uniform.

8. The spectrometer of claim 7 wherein said ion are emitted in said pulses in response to a pulse signal and wherein said event extractor does not generate an ion event record corresponding to signals from said ion detector received during time periods corresponding to the rise and fall of said pulse signal.

9. The spectrometer of claim 1, wherein said spectrometer is being used to analyze samples that generate a range of TOF values including a TOF corresponding to a fastest ion of interest and a TOF corresponding to a slowest ion of interest, and wherein said event extractor only provides aliases corresponding to TOF values between a minimum TOF and a maximum TOF, said minimum TOF corresponding to said fastest ion of interest and said maximum TOF corresponding to said slowest ion of interest.

10. The spectrometer of claim 4 wherein each ion event record includes a count of the number of times said ion event record has been processed by said streaming processor.

11. The spectrometer of claim 4 wherein each ion event record is discarded based on a predetermined storage time limit.

12. A method for operating a spectrometer having an ion detector that detects ions that satisfy a detection criterion, said method comprising:

generating an ion event record corresponding to each of said detected ions, said ion event record including an intensity associated with that detected ion and one or more aliases for that detected ion;

assigning a probability for each alias in each ion event record;

updating a TOF spectrum based on said intensity and said probabilities; and storing said ion event records in a buffer after said ion event records have been used to update said TOF spectrum together; and retrieving one of said ion event records stored in said buffer and updating said TOF spectrum to remove all contributions from said retrieved ion event record, wherein each ion event record stored in said buffer comprises a timestamp, said one of said ion event records being an ion event record that has been in said buffer for longer than a predetermined time based on said timestamp.

13. The method of claim 12 wherein said retrieved one of said ion event records is discarded after said contributions are removed from said TOF spectrum.

14. The method of claim 12 wherein said aliases in said retrieved one of said ion event records are assigned new probabilities based on said TOF spectrum, said TOF spectrum is updated based on said new probabilities, and said retrieved one of said ion event records is stored in said buffer together with said new probabilities.

15. The method of claim 12 wherein said TOF spectrum comprises a memory array comprises a plurality of entries, each entry corresponding to a different possible TOF value for ions detected by said detector and wherein said probabilities of all aliases in an ion event record are set to be equal if all of said memory array entries corresponding said aliases are zero.

16. The method of claim 15 wherein said probability for each alias in said ion event record is proportional to a corresponding entry in said memory array if one of said aliases in said ion event record corresponds to a memory entry in said memory array that is non-zero.

17. The method of claim 12 wherein said ions are emitted in pulses in a pattern that ensures that contributions to said TOF spectrum resulting from incorrect aliases are substantially uniform.

18. The method of claim 12, wherein a sample being input to said spectrometer generates ions having a range of TOF values including a TOF corresponding to a fastest ion of interest and a TOF corresponding to a slowest ion of interest, and wherein aliases are only provided aliases corresponding to TOF values between a minimum TOF and maximum TOF, said minimum TOF corresponding to said fastest ion of interest and said maximum corresponding to said slowest ion of interest.

* * * * *